United States Patent [19]

Tantillo et al.

[11] 3,957,331

[45] May 18, 1976

[54] SWIVEL CONNECTOR FOR ELECTRICAL APPLIANCES

[75] Inventors: James M. Tantillo, Brockton; Donald C. Ramsay, Braintree, both of Mass.

[73] Assignee: Component Manufacturing Service, Inc., West Bridgewater, Mass.

[22] Filed: Mar. 10, 1975

[21] Appl. No.: 557,052

Related U.S. Application Data

[63] Continuation of Ser. No. 475,416, June 3, 1974, abandoned.

[52] U.S. Cl. ..... 339/6 R; 200/62; 339/8 R; 339/68; 339/182 RS

[51] Int. Cl.[2] ..... H01R 39/00

[58] Field of Search ..... 339/8 R, 8 P, 8 PB, 339/8 PS, 8 RL, 8 L, 6 R, 6 RL, 6 A, 45 R, 45 M, 68, 118 RY, 46, 182 RS; 200/62

[56] References Cited

UNITED STATES PATENTS

| | | | |
|---|---|---|---|
| 1,901,040 | 3/1933 | Peroni et al. | 339/182 RS X |
| 2,288,259 | 6/1942 | Gladulich | 339/8 P |
| 2,387,015 | 10/1945 | Gilbertson | 339/182 RS X |

*Primary Examiner*—Roy Lake
*Assistant Examiner*—DeWalden W. Jones
*Attorney, Agent, or Firm*—Wolf, Greenfield & Sacks

[57] ABSTRACT

A swivel connector for mechanically and electrically joining an electric cord to an electrical appliance. First and second connector body sections are axially aligned. A first body section has a plastic casing with an outwardly extending elongated axially aligned prong carrying plural contacts axially spaced from each other. The casing defines a swivel bearing boss coaxial with the prong. The second body section has a contact mounting block and a plastic casing surrounding the block and interlocking with the first casing. The mounting block defines a swivel bearing recess mating with the swivel bearing boss and has an elongated prong receiving recess axially aligned with the swivel bearing recess and boss. A first and second means are provided on the first and second body sections for stopping axial movement of the prong while permitting swiveling movement thereof. A full 360° swivel connection results in a self-contained efficient connector.

2 Claims, 5 Drawing Figures

FIG. 1
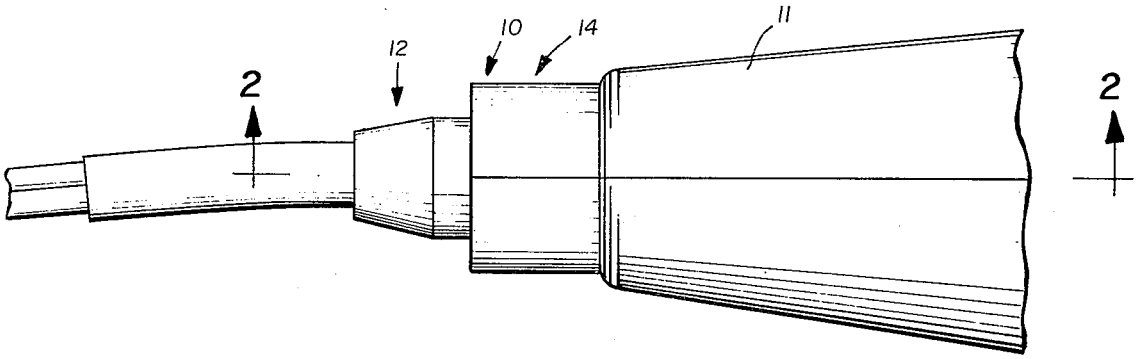
FIG. 2
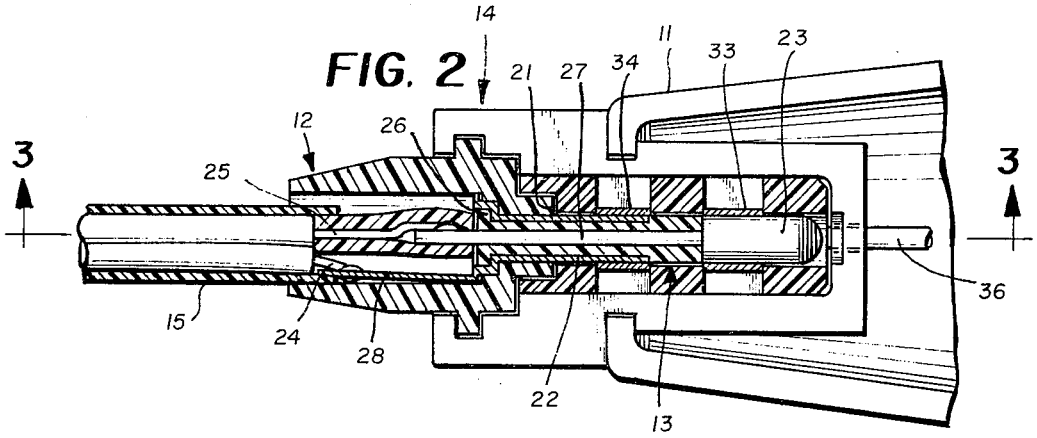
FIG. 3
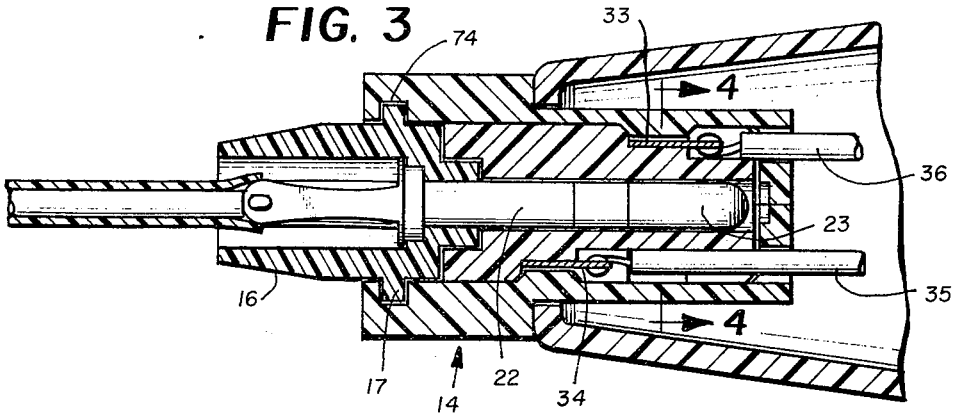
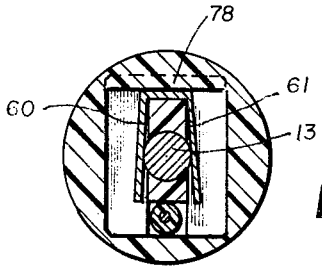
FIG. 4

SWIVEL CONNECTOR FOR ELECTRICAL APPLIANCES

RELATED APPLICATION

This application is a continuation of application Ser. No. 475,416, filed June 3, 1974, now abandoned.

BACKGROUND OF THE INVENTION

Particularly in small hand held electrical appliances, problems arise at the point where the line cord enters the appliance if no provision is made for a swivel connection at this point. Turning of the hand held device tends to twist and unnecessarily strain the line cord. The prior art has in some cases ignored this problem while in other cases provided various swivel joint means for interconnecting a line cord to an electrical appliance while allowing swiveling of the appliance about the axis of the line cord while the line cord remains substantially stationary about its axis. In many cases, it has been a problem to obtain efficient swivel connectors with minimized parts, good electrical contacting action, high reliability and acceptable safety features.

SUMMARY OF THE INVENTION

It is an important object of this invention to provide an electrical swivel connector which permits good electrical contact over 360° swiveling action.

Still another object of this invention is to provide a swivel connector in accordance with the preceding object which has minimized parts and good electrical and mechanical reliability.

Still another object of this invention is to provide a swivel connector in accordance with the preceding objects which affords a double wiping electrical contact and avoids safety hazards in use.

According to the invention a swivel connector for mechanically and electrically joining an electric line cord to an electric appliance, has first and second axially aligned major body sections. The first body section has a first plastic casing with an outwardly extending elongated prong which carries axially spaced first and second contacts. The first casing defines a swivel bearing boss surrounding a portion of the prong and has means mounted on the first casing for coacting with a second means on the second body section for stopping axial movement of the prong when assembled while permitting swivel movement thereof about the central axis. The second body section has a contact mounting block and a second plastic casing constructed and arranged to interlock with the first casing. The mounting block is formed of an insulating material and defines a swivel bearing recess mating with the swivel bearing boss and also has an elongated prong receiving recess axially aligned with the swivel bearing recess swivel bearing and boss. A pair of contacts are axially spaced along the prong receiving recess and resiliently engage corresponding prong contacts. The first and second body sections are mechanically interlocked giving electrical connection while permitting a full 360° swivel action at the joint between the body sections.

It is a feature of this invention that a minimum number of parts can be used to maximize economy and ease of construction. The contacts are preferably double wiping contacts which cut down heat generated during current flow. Positive positioning of the contacts is easily obtained so that no displacement of spring contacts occurs. The mounting block acts to hold electrical contacts and also provides bearing means for positioning of the swiveling prong. The connector is self-contained to give high reliability and preferably complete insulation coverage for maximized safety.

BRIEF DESCRIPTION OF THE DRAWINGS

The above and other features, objects and advantages of the present invention will be better understood from a reading of the following specification when read in conjunction with the accompanying drawings in which:

FIG. 1 is a top plan view of a preferred embodiment of a swivel connector in accordance with this invention attached to the handle of an electric appliance, a fragmentary portion of which is shown;

FIG. 2 is a cross sectional view taken through line 2—2 of FIG. 1;

FIG. 3 is a cross sectional view taken through line 3—3 of FIG. 2;

FIG. 4 is a cross sectional view taken through line 4—4 of FIG. 3; and

BRIEF DESCRIPTION OF PREFERRED EMBODIMENTS

Figure 5:
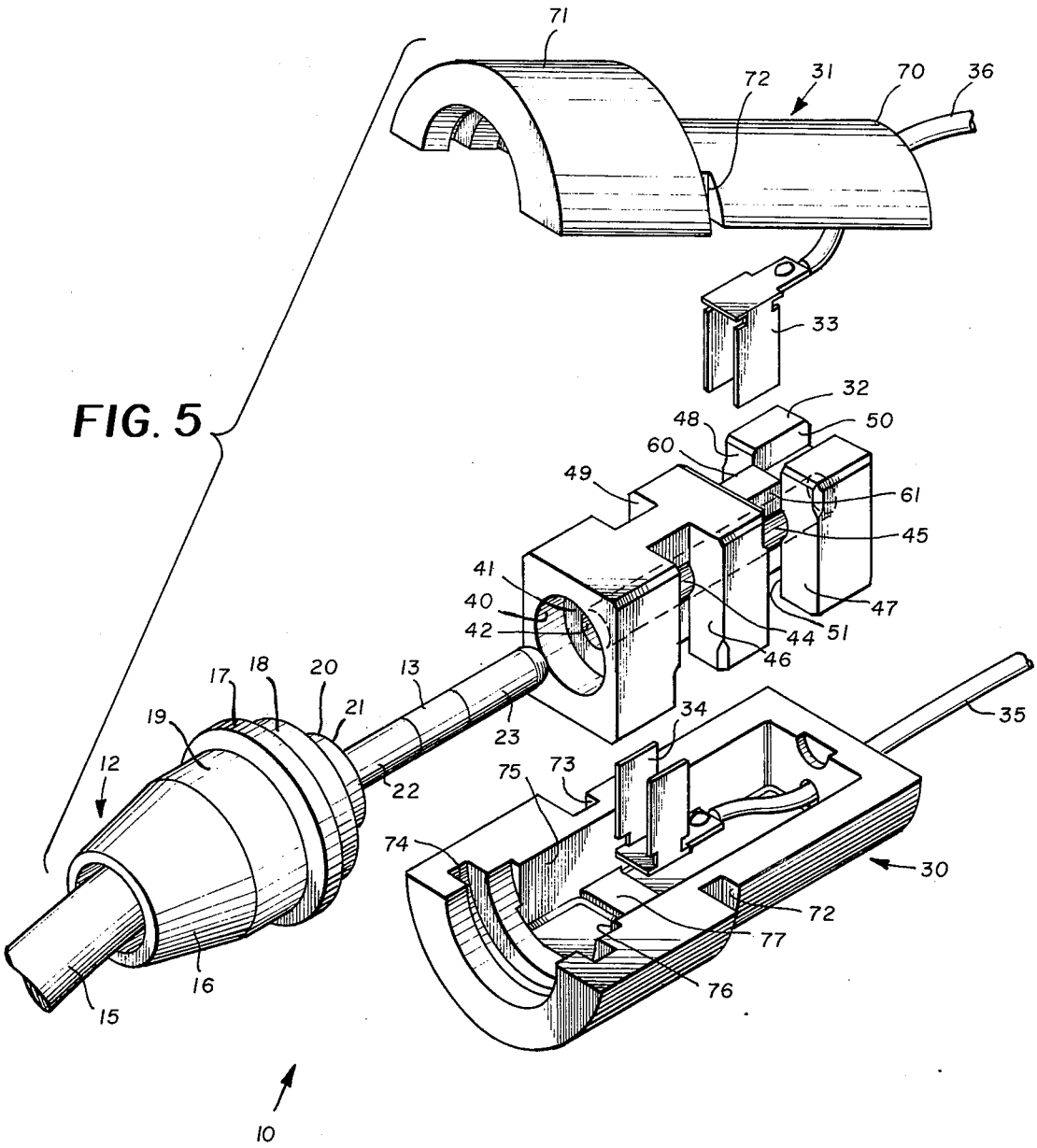
FIG. 5 is an exploded view of the preferred embodiment of the swivel connector of this invention.

With reference now to the drawings and more particularly FIGS. 1 and 5, a preferred embodiment of the swivel connector of this invention is illustrated generally at 10 attached to a handle portion of an electric appliance 11. The electric appliance 11 can be any electric appliance such as a hair dryer, hot comb, hair clipper and the like.

The swivel connector 10 has a first major body section 12 with an outwardly extending prong 13 adapted to mate with a second major body portion 14 in electrical and mechanical contact which permits swiveling of an electrical line cord 15 about its axis through 360° of rotation while the body section 14 is stationary, or vice versa, and prevents axial movement of the body portions with respect to each other from the position shown in FIGS. 2 and 3.

The first major body section 12 is generally circular in cross section with a tapered frustro conical end 16 formed as a unitary plastic piece and preferably is molded directly about the line cord and prong. An upstanding circular boss 17 extends outwardly from the body defining bearing and sliding surfaces thereon and on cylindrical body sections 18 and 19. An inwardly extending boss 20 forms a bearing surface on its outer cylindrical surface as well as on its face 21. The prong member 13 carries cylindrical conductive metallic contacts 22 and 23 electrically connected to individual ones of conductive leads 24 and 25 of the line cord 15. An insulating sleeve 26 positively spaces conductive metallic rod 27 which is electrically interconnected with contact 23. A metallic sleeve 28 is electrically connected to lead 24 at one end and forms contact 22 at the other end. The connections can be conventional solder or mechanical connections or a combination of mechanical and solder connections as known in the art.

The second body section 14 is made up of a two-part casing 30, 31 enclosing a contact mounting block 32 which mounts metallic electrical double wipe U-shaped spring clip contacts 33 and 34. Contact 33 and 34 are electrically connected with the electric leads 35 and 36 of the electric appliance.

The mounting block 32 is preferably formed of a molded plastic such as a glass filled polyester as are other plastic portions of the connector. Any insulating material can be used including Teflon, polypropylene, and the like. Hard thermoplastics which have low coefficients of friction are preferred since they provide excellent sliding and bearing surfaces. The mounting block 32 is preferably in a generally rectangular shape with a forward end defining a first cylindrical opening or recess 40 adapted to mate with boss 20 and having a lower face 41 adapted to mate with surface 21 to provide a bearing surface coacting with the cylindrical surfaces of the boss 20 and recess to provide additional bearing surfaces to permit swivel sliding action.

An elongated circular recess 42 receives the prong 13 and extends throughout the length of the mounting block having side openings at 44 and 45 with corresponding diametrically opposed spaced identical openings opposite each of openings 44 and 45. Openings 44 and 45 are provided by cutout portions in the U-shaped forms of cutout portions 46 and 47 with corresponding U-shaped substantially parallel cutout portions 48 and 49 on an opposite side of the mounting block. Connecting the U-shaped cutout portions for opening 45 is a longitudinally extending notch 50 on the top of the block with a corresponding longitudinally extending notch 51 on the bottom of the block extending to cutout portion 46. The spring contacts 33 and 34 are sized to be snugly received within the block by the cutout portions and lie adjacent corresponding walls 60 and 61 when the prong is not positioned within the mounting block. Each U-shaped spring contact preferably has a pair of generally rectangular leaf arms which are locked against axial movement with respect to the connector by the parallel walls of their respective cutout portions of the contact mounting block. In the assembled final condition of use when the prong is received within the recess 42, as shown in FIG. 4, each contact is resiliently spread apart to form at least two contact points with its adjacent prong contact. This provides a double wiping action of the cylindrical prong contacts which cuts down heat generated during current flow.

Casing sections 30 and 31 are identical to each other and are glued or otherwise adhered to each other during assembly to lock the swivel connector components in position. When assembled, the casing sections 30 and 31 are generally cylindrical defining a first cylindrical surface 70 and a second enlarged cylindrical outer surface 71 with parallel channels 72 and 73 defining notches for engagement of the handle 11 to prevent movement of the second body section 14 with respect to the handle. A cylindrical recess 74 receives cylindrical boss 17 while a cutout chanber 75 receives the mounting block 32 in locking engagement with a groove 76. Raised bosses 77 and 78 extend from the casing recess 75 on casing halves 30 and 31 respectively to positively and firmly urge the spring contacts 34 and 33 respectively into their assembled position preventing displacement of the spring clips and limiting movement from the position shown in FIG. 4.

The swivel connector 10 is assembled by first joining the line cord 15 to contacts of the prong 13 to which the first body section 16 is molded in place. The premolded mounting contact mounting block 32 is then positioned with the prong slidably received within the recess 42 and mating contacts in engagement. The housing sections 30 and 31 are then placed in position with their facing edges joined by adhesive, heat sealing, high frequency sealing or other known means to fully form the swivel joint. In use, the connector is then positioned between mating sections of a handle such as 11 and the handle locked in the position shown in FIG. 1 to complete the assembly.

In use, the prong 13 is firmly locked against axial movement. However, swivel movement is provided by the bearing surfaces of groove 74, boss 20, face 21 and associated adjacent and contacting surfaces.

While a specific embodiment of this invention has been shown and described, many modifications are possible. For example, in some embodiments, the prong carrying body section can be mounted on the handle of the device with the mounting block carrying section being free to swivel. The shape of outer surfaces can vary in accordance with design considerations. In some cases, a strain relief can be molded or applied over the line cord 15 and the junction of the first body section. In some cases, casing halves 30 and 31 can be snap fit together to allow releasability of the joint once formed. Similarly, a disconnect feature can be incorporated in the joint by using various disconnect features rather than a continuous locking groove 74. Thus, groove 74 can be discontinuous with the material of the casing being a rubbery material allowing snap assembly and disassembly of the prong body section from the second body section.

What is claimed is:

1. A swivel connector for mechanically and electrically joining an electric cord to an electric appliance, said connector comprising a first axially aligned major body section and a second axially aligned major body section, said first body section comprising a first plastic casing with an outwardly extending elongated prong, said prong having a central axis with axially spaced first and second contacts thereon, said first casing defining a swivel bearing boss surrounding a portion of said prong, first means mounted on said first casing for coacting with second means on said second body section for together stopping axial movement of said prong while permitting swivel movement thereof about said central axis, said first and second means for stopping axial movement of said prong while permitting swivel movement thereof comprising respectively a circular boss and means defining a mating circular recess, said second body section comprising, a contact mounting block and a second plastic casing constructed and arranged to interlock with said first casing, said mounting block being formed of a plastic material and defining a swivel bearing recess mating with said swivel bearing boss and an elongated prong receiving recess axially aligned with said swivel bearing recess and boss, a pair of contacts axially spaced along said prong receiving recess and resiliently engaging corresponding prong contacts, said pair of contacts each being resilient spring double wiping contacts extending into said prong receiving recess and each comprising a generally U shape having resilient flat leaves for the arms of the U, said second body section plastic casing carrying means for positively positioning said pair of contacts.

2. A swivel connector in accordance with claim 1 and further comprising said second plastic casing defining means for attachment of said swivel connector to an electric appliance in non-rotating relationship therewith.

* * * * *